United States Patent [19]

Buckley et al.

[11] 4,182,387

[45] Jan. 8, 1980

[54] AUTOMATIC FILLING MACHINE

[75] Inventors: Lawrence W. Buckley, Baltimore; Richard N. Bennett, Arbutus, both of Md.

[73] Assignee: National Instrument Company, Inc., Baltimore, Md.

[21] Appl. No.: 950,285

[22] Filed: Oct. 11, 1978

[51] Int. Cl.[2] ..... B65B 3/04

[52] U.S. Cl. ..... 141/129; 141/152; 141/178; 141/266; 74/600; 92/13.3; 92/13.7; 222/180

[58] Field of Search ..... 141/99, 129, 152, 155, 141/168–191, 101, 258–262, 266, 367, 378, 231, 234, 235, 237, 392, 1; 222/180; 417/238, 521; 53/201; 92/5 R, 13.3, 13.7; 74/600, 601

[56] References Cited

U.S. PATENT DOCUMENTS

| | | | |
|---|---|---|---|
| 2,807,213 | 9/1957 | Rosen | 222/180 |
| 4,077,441 | 3/1978 | Rosen et al. | 141/1 |
| 4,083,389 | 4/1978 | Rosen et al. | 141/180 |

*Primary Examiner*—Houston S. Bell, Jr.
*Attorney, Agent, or Firm*—Craig and Antonelli

[57] ABSTRACT

A filling machine for filling several containers with predetermined amounts of a product in which the several filling units are actuated by a common driving member; the common driving member itself is actuated by two eccentric drive mechanisms each including a volume-changing adjusting mechanism of the lead screw type; the eccentric drive mechanisms are adapted to be stopped in a predetermined position by a volume-changing stoppage device to enable the installation of an interconnecting member between the two volume-changing adjusting mechanisms to assure identical adjustments.

27 Claims, 5 Drawing Figures

AUTOMATIC FILLING MACHINE

The present invention relates to a filling machine for simultaneously filling several containers with a predetermined amount of a product, and more particularly to a volume-changing adjusting means for such machines.

Filling machines of the type to which the present invention relates are known as such in the prior art. For example, the U.S. Pat. No. 2,807,213 discloses a filling machine in which each filling unit is individually driven from an eccentric drive mechanism to meter a predetermined amount of a product to be filled into the corresponding container by way of the respective nozzle. Moreover, filling machines in which several filling units are driven simultaneously from a common drive bar are also known in the prior art, as disclosed, for example, in the U.S. Pat. No. 4,077,441. In the latter type filling machine, a common drive bar is actuated from two eccentric drive mechanisms, each including a volume-changing lead screw assembly of the type disclosed in the aforementioned U.S. Pat. No. 2,807,213. Each volume-changing adjusting mechanism thereby includes its own lead screw assembly which, during a change in volume, had to be adjusted individually after stoppage of the filling machine by rotating the lead screw thereof in a given direction. Since the accuracy for an identical adjustment of each such volume-changing adjusting mechanism depends on the skill of the person carrying out the adjusting operation, and since individual adjustments of the lead screws inherently entail the danger of dissimilar adjustments thereof, there always existed the danger in the prior art volume-changing mechanisms that adjustments were made in the several adjusting mechanisms thereof which were not exactly identical. Moreover, the adjustments with the prior art machines required separate adjusting operations, namely, one for each adjusting mechanism, thereby requiring a relatively large amount of time to make these adjustments, particularly as they had to be undertaken as carefully as possible to avoid discrepancies in the adjustments.

Additionally, if, for example, eight filling units were actuated from a common drive member, no possibility existed in these prior art filling machines to compensate for minor differences in the operating filling characteristics of the individual filling units.

The present invention is therefore concerned with the task to avoid the aforementioned shortcomings and drawbacks by simple means and to provide means for selectively and simultaneously adjusting all of the volume-changing adjusting mechanisms so as to minimize the danger of differing adjustments thereof.

The underlying problems are solved according to the present invention in that an interconnection is provided for selectively interconnecting two lead-screw-type volume-changing adjusting mechanisms with each other while a volume-change stopping system assures the stoppage of the driving members, driving the common drive bar, in a predetermined position to enable the installation of the interconnecting member. The volume-change stopping system thereby stops the two eccentric driving members in such a position that the lead-screw assemblies thereof are aligned with the respective axes thereof to permit the installation of a spring-loaded two-partite telescoping interconnecting member between the aligned lead screw assemblies. The lead screw assemblies as well as the telescoping interconnecting member are provided with form-locking engaging means to cause rotation of one lead screw assembly upon rotation of the other lead screw assembly. Moreover, a manual volume-changing actuating member adapted to be connected by a similar form-locking engaging means with one of the lead screw assemblies is used to manually rotate one of the lead screw assemblies for adjustment in unison of the two interconnected lead screw assemblies. To prevent the inadvertent restarting of the eccentric driving members driving the common drive bar before the interconnecting member is removed upon completion of a volume adjustment, a volume-changing safety switch is provided which precludes restarting of the driving members before removal of the interconnecting member. In a preferred embodiment of the present invention, the volume-change stopping means as also the volume changing safety switch are both normally closed switches, connected in series with the control circuit controlling the operation of the drive mechanism for the filling machine.

If several or all of the filling units of the filling machine are actuated in unison by a common drive bar, a further volume-adjusting mechanism may also be provided according to this invention for each filling unit to permit an individual trimmer adjustment of each filling unit. In a preferred embodiment of the present invention, the further volume-adjusting mechanism is of such construction that an adjustable lost-motion is utilized which selectively varies the lost motion between the cylinder of a given filling unit and the relatively fixed part, to which the cylinder is operatively connected, to thereby selectively vary the suction and discharge strokes of the corresponding pump assembly. In a particularly advantageous construction of the present invention, the further volume-adjusting mechanism, of which one each is provided for each filling unit, includes a swivel member provided with an elongated slot in which a bearing member having a bearing portion of a width substantially complementary to the width of the slot, is able to slide to and fro corresponding to the amount of lost motion preselected by the position of a threaded adjusting member, adapted to be selectively screwed in and out of a threaded bore provided in the swivel member at least approximately coaxially with the longitudinal direction of the slot. A particularly simple assembly of the various parts of the further volume-adjusting mechanism results if the bearing member includes a collar portion of a diameter larger than the width of the slot and if the bearing member is operatively connected with the relatively fixed part in such a manner that the swivel member is disposed between the collar portion and the relatively fixed part.

The present invention is characterized by several advantages. First of all, it greatly facilitates the volume-changing adjustment by means of individual lead screw assemblies operatively connecting disk-like driving members with a common drive bar to provide different amounts of eccentricity. Additionally, the present invention eliminates the likelihood of dissimilar adjustments of the individual volume-changing lead-screw assemblies. Furthermore, the volume-changing adjusting installation of the present invention assures automatic stoppage of the filling machine in a position which enables the easy installation of the interconnecting member as well as of the manual actuating member for the subsequent volume-changing adjustments and offers great safety by the presence of a safety switch that prevents the restarting of the machine before the interconnecting member is again removed from the filling machine. Finally, the present invention also offers a simple trimmer adjustment for each filling unit to compensate for minor differences in the operating characteristics thereof which can be selectively adjusted while the machine continues to run.

Accordingly, it is an object of the present invention to provide a filling machine of the type described above which avoids by simple means the aforementioned shortcomings and drawbacks encountered in the prior art.

Another object of the present invention resides in a volume-changing adjusting installation for high-speed filling machines which enables a simultaneous adjustment of the two volume-changing lead screw assemblies used for that purpose.

A further object of the present invention resides in a volume-changing adjusting mechanism of such construction that the handling and operation thereof is greatly facilitated, even if carried out by relatively lesser skilled personnel, while the accuracy of identical adjustments of the two volume-adjusting mechanisms is assured thereby.

Still aother object of the present invention resides in a filling machine equipped with a common drive member for driving all of the filling units thereof, which is drivingly connected with two disk-like driving members each carrying an adjustable eccentric pin, adapted to be adjusted in its eccentricity by a respective lead screw assembly, in which the lead screw assemblies can be selectively adjusted in unison.

Still a further object of the present invention resides in a filling machine equipped with a volume-changing adjusting installation assuring simultaneous, accurate adjustment of the two lead screw type volume-changing adjusting mechanisms operatively connecting the driving members with a common drive member, while at the same time enabling trimmer adjustments of each individual filling unit by extremely simple means.

Another object of the present invention resides in a filling machine equipped with a common volume-changing adjusting installation for all filling units, adapted to be operated during stoppage of the machine, and with an individual volume-changing trimmer adjusting mechanism for each filling unit adapted to be selectively adjusted during operation of the machine.

These and other objects, features and advantages of the present invention will become more apparent from the following description when taken in connection with the accompanying drawing which shows, for purposes of illustration only, two embodiments in accordance with the present invention, and wherein.

Figure 1:
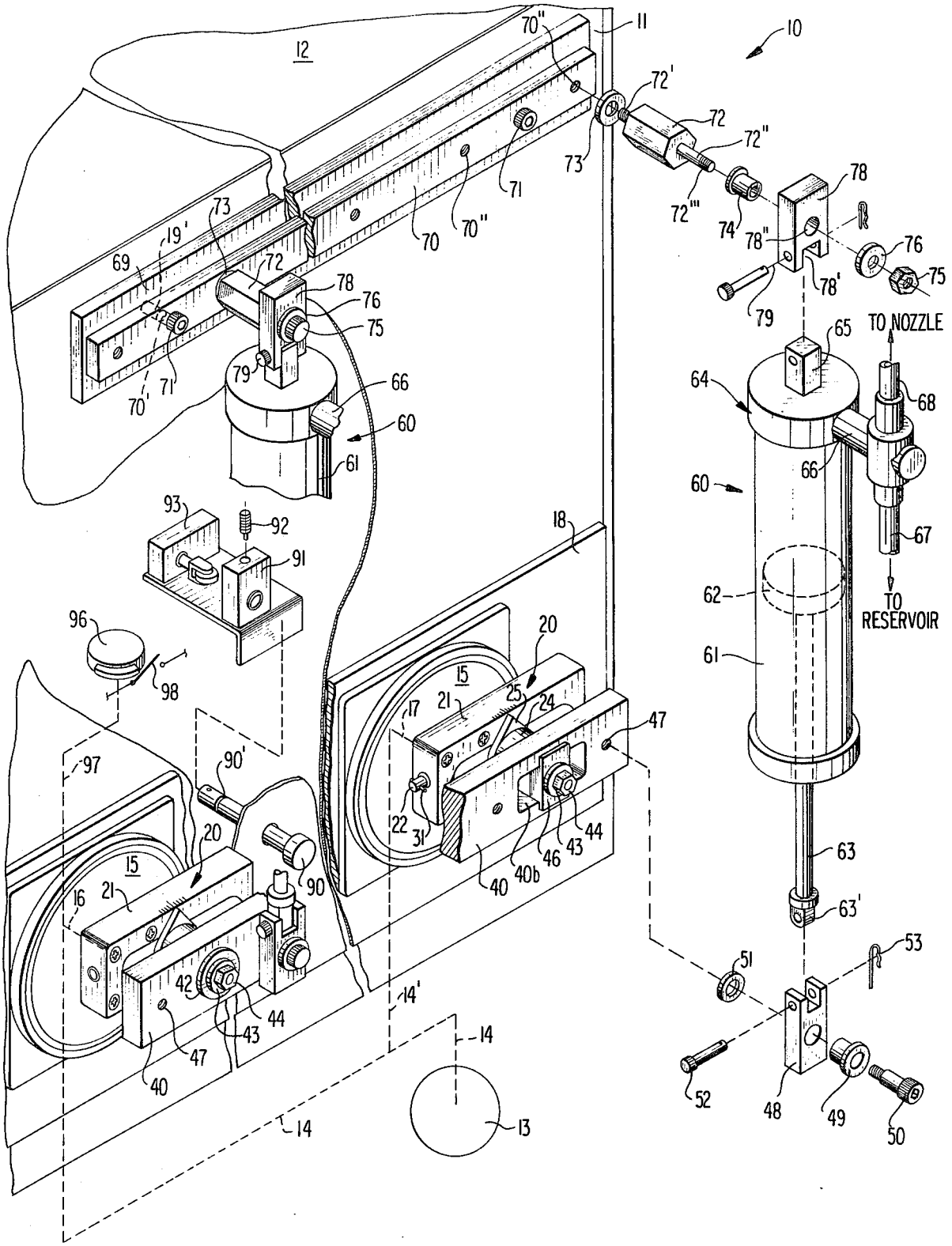
FIG. 1 is a partial perspective view, partly broken away and partly exploded, illustrating the parts of a volume-changing adjusting installation of the present invention for a filling machine of otherwise conventional construction.
Figure 4:
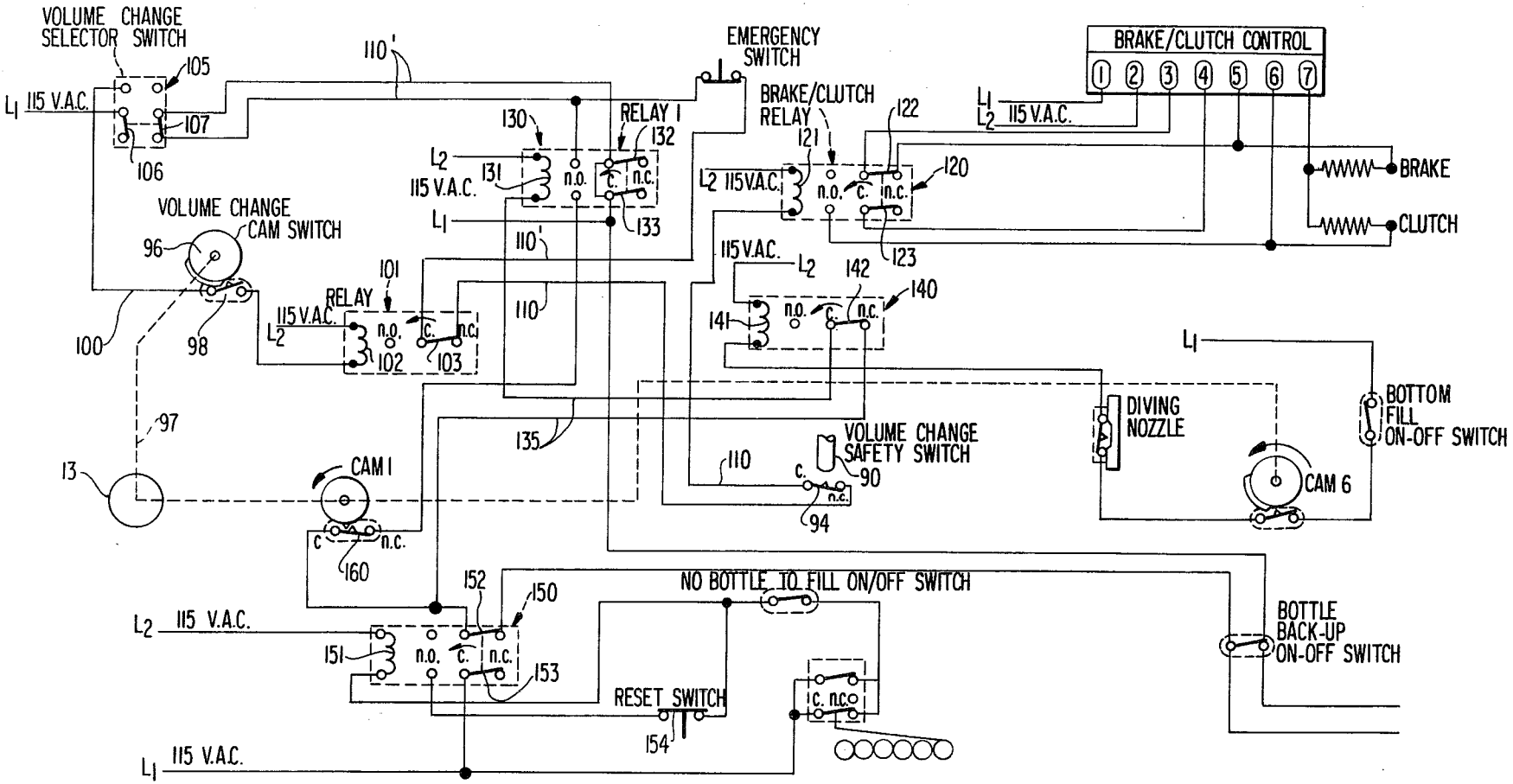
Figure 5:
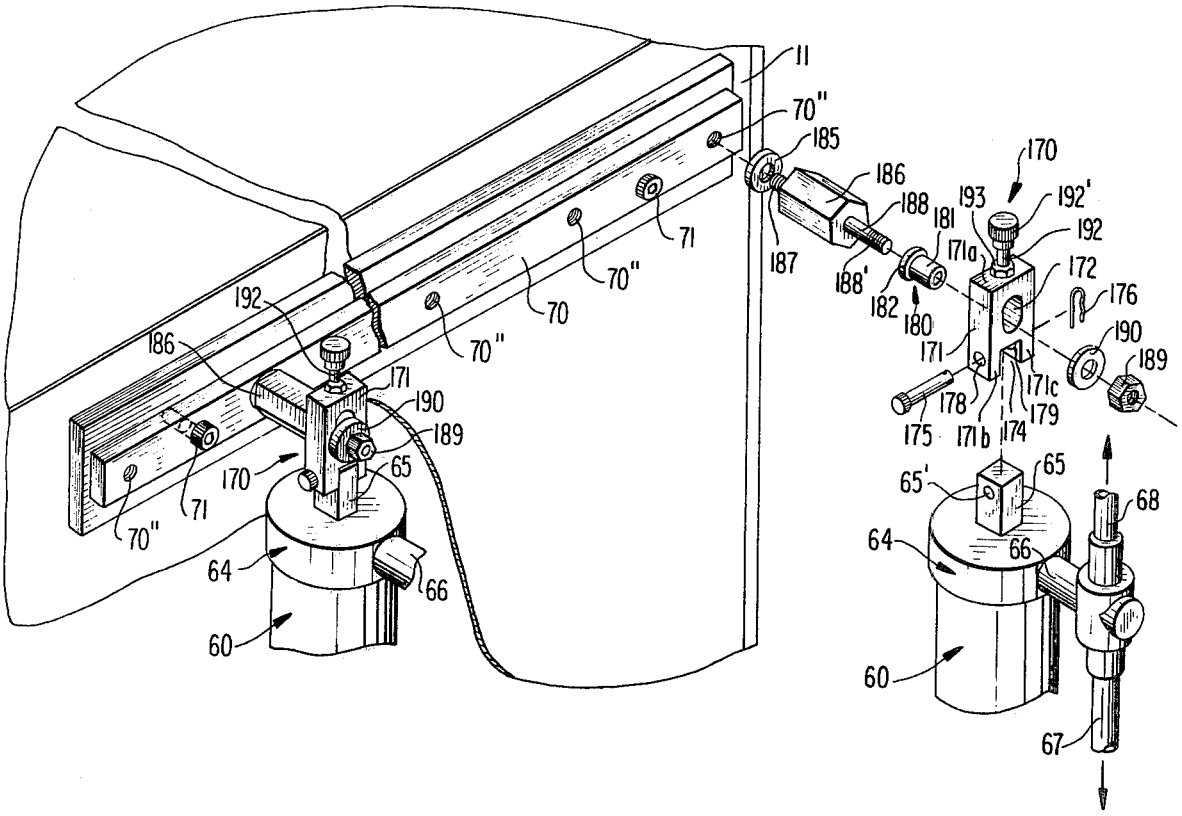

FIG. 4 is a schematic circuit diagram illustrating a control circuit for a filling machine equipped with a volume-changing installation of the present invention; and FIG. 5 is a partial perspective view, partly exploded and illustrating a filling machine, similar to FIG. 1, but equipped with an individual volume-changing trimmer adjusting mechanism in accordance with the present invention for each filling unit.

In the instant application, only those parts will be described in detail which are concerned with the present invention. The filling machine is otherwise of conventional construction and is of the type disclosed, for example, in the U.S. Pat. No. 4,077,441, combined with a star-wheel indexing mechanism of the type disclosed in the U.S. Pat. No. 4,083,389. However, the indexing mechanism as well as the actuating and control mechanisms for the various parts of the filling machine may also be of any other known type.

Referring now to the drawing, wherein like reference numerals are used throughout the various views to designate like parts, and more particularly to FIG. 1, the filling machine generally designated by reference numeral 10 includes a frame 11 of any suitable construction, on which are mounted the housing panels 12 of the machine. A conventional driving clutch-and-brake motor 13 (schematically indicated) is drivingly connected with two disk-like driving members 15 by way of driving connections 14 and 14' and shafts 16 and 17. The disk-like driving members 15 are connected with shafts 16 and 17, shown only schematically in FIG. 1, so as to rotate in unison therewith. A pump bearing plate 18 is suitably secured to the frame 11 by conventional means to support thereon the bearing housings (not shown) for the shafts 16 and 17.

The volume control assembly generally designated by reference numeral 20 (FIGS. 1, 2 and 3) includes a slotted body member 21 provided with an elongated slot 21' through which extends a lead screw 22 provided with a cross bore 22' near each respective end thereof. The lead screw follower 23 which is provided with a threaded bore 23' for engagement with the threaded portion of the lead screw 22 has a bearing portion **23*a* (FIG. 3) of complementary configuration to the width of the slot 21'. A bearing sleeve 24 is adapted to be mounted over the offset bearing portion 23*b* after the lead follower 23 is extended through the slot 21', possibly by the interposition of an indicator washer 25; the lead screw follower 23 is held fast in the assembled position by the use of a nut 26 engaging with the threaded end portion of the lead screw follower 23 by the interposition of a washer 27. This will retain the lead screw follower 23 axially assembled in the slot 21' but movable longitudinally relative thereof. The lead screw 22 itself is rotatably but axially immovably supported relative to the body member 21 by any conventional means, for example, by the use of the collar 22a on the lead screw 22 and the bushing 29 secured over the opposite end of the lead screw 22. A lead screw bushing 28 as well as an adjusting knob 30 are normally mounted over the right end portion of the lead screw 22, as viewed in FIG. 3 to facilitate rotation thereof. As is quite apparent, rotation of the adjusting knob 30 will cause the lead screw follower 23 to move in the longitudinal direction of the slot 21' and therewith change the eccentricity of the eccentric drive 15, 20, 24. Cross pins 31 are adapted to be pressed into the cross bores 22' to form part of a form-locking engagement to be described more fully hereinafter. The volume control assembly 20 described so far which is known as such in the prior art, permits a volume change by changing the eccentricity of the lead screw follower 23 and bearing sleeve 24** mounted thereon with respect to the axis of rotation of the disk-like driving members 15, whereby the bearing sleeve 24 serves as eccentric driving pin for actuating the common drive bar 40 of all of the filling units.

For purposes of connecting the common drive bar 40 with the two eccentric drive mechanisms, a bushing 41 (FIG. 2) which is mounted over the bearing portion of a respective bearing sleeve 24, fits with its bearing portion into the left-hand, circular hole 40*a* provided for that purpose in the common drive bar 40. A complementary bushing 42 also fits into the hole 40*a* from the opposite side thereof, the common drive bar 40 being secured to the left eccentric drive mechanism 20 of FIG. 2 by the use of a nut 43 threadably engaging the threaded end of the bearing sleeve 24 by interposition of a washer 43.

To avoid undue stresses in the drive mechanism, the second, right-hand opening 40*b* provided in the common drive bar 40 is of rectangular configuration to permit automatic compensation for inaccuracies in manufacture. Two square bushings 45 and 46, adapted to fit into the rectangular opening 40b from opposite sides of the common drive bar 40, are adapted to be mounted from opposite sides of the slot 40*b* over the bearing portion of the respective bearing sleeve 24. A nut 44 with interposition of a washer 43 is again used to secure the right end of the common drive bar 40 to the eccentric actuating mechanism 20. The common drive bar 40 is provided with a predetermined number of threaded bores 47 to threadably secure thereto a corresponding lower swivel member 48 by means of a socket head cap screw 50 and washers 49 and 51. A cross pin 52 (FIGS. 1 and 2) as well as a cotter pin 53 are used to pivotally connect the lower swivel member 48 with the piston rod 63 (FIG. 1) of a filling unit generally designated by reference numeral 60 by way of a complementary piston rod lug 63′ provided with a cross bore. The number of threaded bores 47 is thereby equal to the number of filling units 60 to be driven or actuated in unison by the common drive bar 40.

Each filling unit 60 includes a cylinder 61 accommodating therein a reciprocating piston 62 carried by the piston rod 63. The open end of the cylinder 61 is closed off by an end cover assembly generally designated by reference numeral 64 which is provided with an upwardly projecting connecting lug portion 65 and a valve housing 66, to which are secured a suction connection 67 leading to a reservoir for the product to be dispensed by the filling unit 60 and a discharge connection 68 leading to the corresponding nozzle (not shown) which may be of the type enabling a botton-up filling operation.

A common pump post mounting bar 70 provided with a number of unthreaded bores 70′ and a number of threaded bores 70″ corresponding to the number of threaded bores 47 in the common drive bar 40, is suitably secured to the pump mounting plate 18 by means of cap screws 71, extending through the unthreaded bores 70′ and engaging with corresponding threaded bores provided in the pump mounting plate 69 secured to frame 11. For purposes of securing the upper end of a respective filling unit to the common pump post mounting bar 70, an upper pump post 72 provided with a threaded end portion 72′ is screwed into a respective threaded bore 70″ by interposition of an upper pump post washer 73. An upper bearing sleeve 74 is mounted over the bearing portion 72″, and the upper swivel member 78 is mounted over the upper bearing sleeve 74 with its corresponding circular hole 78″. To hold the parts 74 and 78 properly assembled, a pump post nut 75 is screwed over the right threaded end portion 72″ of the pump post 72 by interposition of a washer 76. The connecting lug portion 65 is thereby of such configuration as to fit into the cut-out or notch 78′ and is secured to the upper swivel member 78 by the pivotal connection 79.

Figure 2:
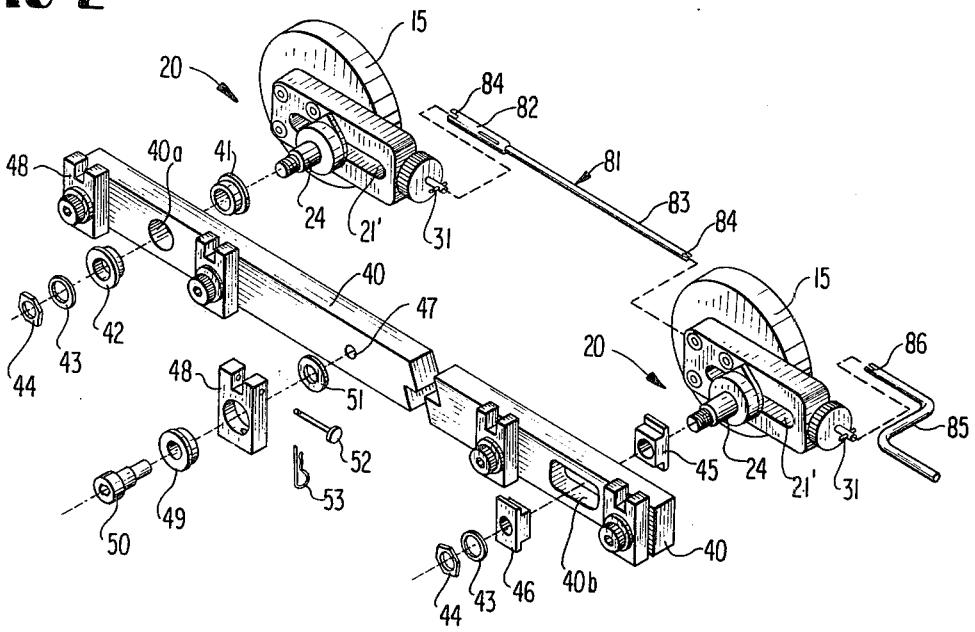
FIG. 2 is a perspective, exploded view illustrating the common volume-changing adjusting installation of the present invention.
Figure 3:
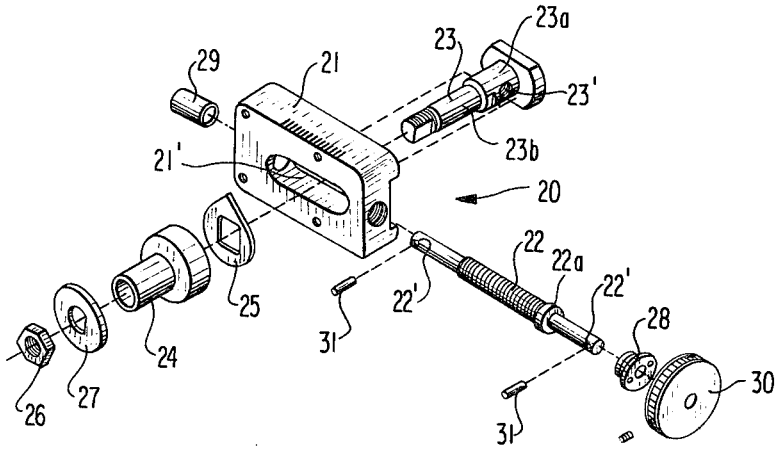
FIG. 3 is an exploded view, on an enlarged scale, illustrating a lead screw volume-changing mechanism as used with the present invention.

According to the present invention, a two-partite telescoping interconnecting member generally designated by reference numeral 81 (FIG. 2) which includes an outer part 82 and an inner part 83 spring-loaded with respect to each other into the extended position, as determined by a conventional slot-and-guide arrangement enabling limited relative axial movement but precluding relative rotational movement, is provided to interconnect with each other the two lead screws 22 of the two volume-changing adjusting mechanisms 20. For that purpose, the inner and outer parts 83 and 82 are each provided with diagonal slots 84 which, in combination with the cross pins 31, form part of the form-locking connection. A manual adjusting member 85 in the shape of a crank is also provided at one end with a diagonal slot 86 to engage with the corresponding cross pin 31 as shown in FIG. 2. With the machine stopped in the position shown in FIG. 2, in which the lead screws 22 are in axial alignment, the two-partite telescoping member 81 is inserted between the two lead screws 22 by pressing its two parts 82 and 83 toward each other to temporarily shorten the member 81 against spring action and thereby permit the cross pins 31 to engage in slots 84. The crank 85 is also installed by engagement of its notches 86 with the cross pin 31. As is quite apparent from FIG. 2, rotation of the crank 85 in one or the other direction will cause an identical rotary movement of both volume-changing adjusting mechanisms 20. Upon completion of the adjusting operation, the interconnecting member 81 as well as the crank 85 can again be readily removed to permit continued operation of the filling machine.

To cause stoppage of the machine in the position illustrated in FIG. 2, i.e., with the lead screws 22 axially aligned, the filling machine according to the present invention includes a control circuit which will be described briefly by reference to FIG. 4. In this figure, in which only those parts concerned with the present invention will be described, reference numeral 100 designates an energizing circuit for the winding 102 of a volume-changing control relay generally designated by reference numeral 101. The relay 101 includes a normally closed contact 103 which opens upon energization of the winding 102. A double-pole double-throw volume-changing selector switch generally designated by reference numeral 105 which includes contact members 106 and 107, is illustrated in FIG. 4 in its normal position, in which the filling machine is able to operate in the normal manner and in which contact member 106 provides an open circuit for the power line $L_1$ while contact member 107 closes a series circuit 110′, 110 for the brake-clutch relay generally designated by reference numeral 102 as will be described more fully hereinafter. When the volume-changing selector switch 105 in thrown into its opposite position, the power line $L_1$ is connected with the energizing circuit 100 and will cause the energizing winding 102 of relay 101 to be energized as soon as the volume-change cam 96 which is drivingly connected with the motor 13 by way of the drive connection 97 closes its normally open switch 98 when the lead screws 22 reach their aligned position. While contact member 106 of switch 105 thus provides for the connection with line $L_1$ to permit energization of the winding 102 at the correct moment of the position of the lead screws 22 when contact 98 closes, contact member 107 in the meantime opens the series circuit 110', 110 which when closed energizes the brake-clutch relay 120 to operate the filling machine. However, the winding 121 of the brake-clutch relay 120 is not de-energized until contact 98 actually closes, notwithstanding the opening of circuit 110' by contact member 107 because control relay generally designated by reference numeral 130 is energized at that time by way of the line 135 and of the normally closed contact 142 of plug-in relay generally designated by reference numeral 140 as well as by way of the normally closed contact 152 of the reset relay generally designated by reference numeral 150 or by way of the normally closed contact 160 of cam I. Consequently, the energizing winding 121 of the brake-clutch relay 120 continues to remain energized by way of its energizing circuit 110 including the normally closed contact 94 of the volume-changing safety switch 90, the normally closed contact 103 of control relay 101, the normally closed emergency switch as well as the contact 132 of control relay 130 providing a connection with the $L_1$ side of the A.C. line. However, as soon as the volume-changing cam switch 96 closes the normally open contact 98 thereof, coil 102 is energized which causes the normally closed contact 103 to open. As a result thereof, the energizing circuit for the winding 121 of the brake-clutch relay 120 is opened and relay 120 is thus de-energized, thereby causing the contacts 122 and 123 thereof to change-over and to thereby disengage the clutch of the clutch-brake motor 13 while engaging the brake thereof. The reset relay generally designated by reference numeral 150 includes a winding 151 and two normally closed contacts 152 and 153 which change-over from the illustrated position when the winding 151 is energized. As is quite apparent, once relay 150 is energized, the reset switch 154 forms part of a holding circuit to maintain the winding 151 energized until the reset switch is opened. Since the other details of the control circuit form no part of the present invention, a detailed description thereof is dispensed with herein. Moreover, since the volume-changing safety switch 90, 94 is connected in series with the contact 103 of relay 101 in the energizing circuit 110 of the winding 121 of the brake-clutch relay 120, the opening of the normally closed switch 94 precludes a restarting of the filling machine, even though after the volume-changing adjustment the volume-changing selector switch 105 is returned again to the normal operating position, as shown in the drawing, because the energizing circuit 110 of relay 121 remains open as long as switch 94 is open. The volume-changing safety switch 90 which is in the form of a push-button actuator extending through the housing of the filling machine to the side thereof containing the actuating mechanisms 15, 20, 40, is guided on the inside of the housing in a guide block 91 (FIG. 1) equipped with a spring plunger 92 adapted to engage with the detent groove 90' of the switch stem when the switch 90 is depressed and thereby opens the normally closed contact 94 (FIG. 4) of the microswitch assembly 93. Since the safety switch 90 is so located relative to the axial alignment of the lead screws 22 that the interconnecting member 81 cannot be installed unless the safety switch 90 is depressed to cause opening of the microswitch 93, the filling machine cannot be restarted inadvertently while the interconnecting member 81 is still installed since it is impossible to pull the safety switch 90 out. Since the safety switch 90 can be pulled out again only after the interconnecting member 81 is removed, the safety switch 90 thus forms a safety feature against the inadvertent restarting of the filling machine if the selector switch 105 is returned to its normal position before the interconnecting member 81 is removed.

In operation, the volume-changing selector switch 105 is switched-over from its illustrated position when a change in volume by means of the volume-adjusting mechanisms 20 is desired. The eccentric drive mechanisms will then be stopped with the lead screw axes thereof aligned as soon as the cam 96 closes the contact 98 in the correct position, thereby causing the clutch-brake motor 13 to be stopped at that instant. To install the interconnecting member 81 after stoppage of the machine, it is first necessary to depress the safety switch 90 to physically move it out of its interfering position, thereby opening also the series-connected normally closed contact 94 of the microswitch 93. Upon completion of the volume-changing adjustment, the interconnecting member 81 has to be first removed before the safety switch 90 can be pulled out again to permit restarting of the filling machine. Thus, the present invention precludes an inadvertent restarting of the filling machine with the interconnecting member 81 still in the installed position which might damage the machine.

While the present invention provides for a volume-changing adjustment of all of the filling units in unison, thereby minimizing discrepancies in the amounts dispensed by each filling unit, FIG. 5 illustrates a preferred embodiment in which each filling unit 60 is additionally provided with an individual volume-changing adjusting mechanism providing for trimmer adjustments. The individual trimmer volume-adjusting mechanism according to the present invention generally designated by reference numeral 170 again includes an upper swivel member 171 of generally rectangular configuration but contrary to the swivel member 78 of FIG. 1, is provided with an elongated slot 172 of predetermined width. The slot 172 is defined by straight longitudinal parallel side portions and by semi-cylindrical end surfaces. The upper swivel member 171 is also provided with a threaded bore (not shown) that extends in the longitudinal direction of the slot 172 substantially coaxially therewith from the upper end surface 171*a* of the upper swivel member 171 into the slot 172. The opposite end of the swivel member 171 is provided with a cut-out or notch 174, similar to cut-out 78' of FIG. 1, which again represents a rectangular notch defined by the mutual facing surfaces of the leg portions 171*b* and 171*c* of the swivel member 171. A transverse bore 178 extends through the leg 171*b*, and a corresponding bore 179 extends through the leg 171*c*. The lug-like connecting member 65 of the end cover assembly 64 is again of a configuration essentially complementary to the notch 174 to permit pivotal assembly of the cylinder end cover assembly 64 onto the swivel member 171 by the use of a connecting pin 175 extending through bores 178 and 179 as well as through the bore 65' in the lug portion 65. A cotter pin 176 is used to hold the pin 175 in the assembled condition. The adjusting mechanism 170 of the present invention further includes a bearing member generally designated by reference numeral 180 which consists of a cylindrical bearing portion 181 having a diametric dimension complementary to but slightly less than the width of the slot 172 and of a collar portion 182 which is larger in diametric dimension than the width of slot 172. The bushing-like bearing member 180 is mounted over the bearing portion 188 of the upper pump post 186 which is screwed by means of its threaded end 187 into a threaded bore 70'' by interposition of a washer 185. To hold the swivel member 171 secured onto the upper pump post 186, a nut 189 is screwed over the threaded end portion 188' by the interposition of a washer 190 after the parts have been assembled as indicated in FIG. 5. Since both the collar portion 182 as well as the washer 190 are of a diametric dimension greater than the width of the slot 172, the swivel member 171 is held in place on the bearing portion 181 between the collar portion 182 and the washer 190. A threaded adjusting member 192 having a knurled knob portion 192' is adapted to be screwed into and out of the threaded bore (not shown) provided in the swivel member 171, whereby the position of the adjusting member 192, 192' in any given position may be fixed by a lock nut 193.

Since the elongated slot 172 is of greater dimension in the longitudinal direction thereof than in width, the swivel member 171 is able, in principle, to move relative to the bearing member 180 and therewith relative to the fixed upper pump post 186 and to the fixed upper mounting bar 170 by a distance corresponding to the travel or lost-motion permitted within the slot 172 by the adjusting member 192. In the absence of the adjusting member 192, such travel would be the length of the slot 172, thereby corresponding to a maximum of lost motion between the swivel member 171 and the bearing member 180. However, this lost motion can be varied by screwing the adjusting member 192 more or less into the slot 172.

In operation, the maximum pump stroke of a filling unit 60 is thus realized when the adjusting member 192 is screwed so far into the slot 172 that practically no lost-motion exists between the bearing member 180 and the swivel member 171. Under these circumstances, in the absence of any such lost motion between the filling unit parts 60, 64, 65 and the swivel member 171, on the one hand, and the parts 180, 186 and 70 of the fixed mounting, on the other, the pump stroke of a respective filling unit 60 is maximum since no lost motion exists when the filling unit 60 is actuated by rotation of the disk-like members 15 causing the common lower drive bar 40 to actuate the corresponding piston rod 63. On the other hand, the minimum pump stroke is realized if the adjusting screw 192 is screwed out of the threaded bore in the swivel member 171 to such an extent that the bearing member 180 is able to travel with its bearing portion 181 the full length of the slot 172. Under those conditions, assuming that the piston 62 nears the upper dead-center position of the discharge stroke, the bearing portion 181 is in engagement at that time with the upper cylindrical end surface of slot 172. As the suction stroke now beings, the bearing portion 181 will now pass through a maximum of lost-motion corresponding to its travel from engagement with the upper end surface of the slot 172 into engagement with the lower end surface thereof so that the maximum lost-motion correspondingly reduces the suction stroke of the cylinder piston assembly of the filling unit 60. Similarly, at the beginning of the discharge stroke, the bearing portion 181 will again go through the lost-motion by travelling from its engagement with the lower end surface of the slot 172 into engagement with the upper end surface thereof. Of course, any intermediate position of the adjusting screw 192 will correspondingly change the lost-motion and therewith the effective length of the stroke of the piston in the cylinder of the filling unit 60. It can thus be seen that the adjusting mechanism 170 of the present invention provides for a fine, highly accurate trimmer adjustment of the volume metered by an individual filling unit. Any discrepancies or differences in the operating characteristics of a filling unit of the several filling units actuated in unison by the common drive bar 40 can thus be readily compensated for without having to stop the machine. In other words, the trimmer adjustment of the present invention can be undertaken while the machine continues to operate, to compensate for minor changes in operating characteristics.

While we have shown and described two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A filling machine for simultaneously filling several containers with predetermined amounts of a product, comprising several spaced nozzle means corresponding in number to the several containers to be filled simultaneously, a number of filling units corresponding to the number of nozzle means, each filling unit forming a pump assembly including cylinder means, piston means carried by a piston rod and adapted to reciprocate in said cylinder means to provide suction and discharge strokes, and suction and discharge means in communication with the pump space of the cylinder means, a respective discharge means being adapted to be connected with a corresponding nozzle means and a respective suction means being adapted to be connected with a supply of the product, the cylinder means being operatively connected with a relatively fixed part of the machine, and common actuating means for the piston rods of the several filling units including two driving members, a common driven member and two volume-changing means operatively connecting the driving members with the driven member to permit selective change of the amount of the product to be dispensed by the filling units, characterized by interconnecting means for interconnecting the two volume-changing means with each other to enable adjustment of the two volume-changing means in unison, and volume-change-stopping means for stopping the driving members in a predetermined position to enable installation of the interconnecting means between the two volume-changing means.

2. A filling machine according to claim 1, characterized in that the volume-changing means include lead screw adjusting means, the volume-change-stopping means stopping the driving members in such a position that the lead screw means are at least nearly aligned with the respective axes thereof.

3. A filling machine according to claim 2, characterized in that the interconnecting means includes a spring-loaded two-partite telescoping connecting member adapted to be installed between the at least nearly aligned lead screw means.

4. A filling machine according to claim 3, characterized in that the lead screw means and the telescoping connecting member are provided with form-locking engaging means to cause rotation of one lead screw means upon rotation of the other lead screw means.

5. A filling machine according to claim 4, characterized in that the form-locking engaging means include a cross pin near each of the mutually facing ends of the two lead screw means, and complementary, radially opposite notches in both ends of the connecting member for engagement with the cross pins.

6. A filling unit according to claim 5, characterized in that at least the lead screw means of one of the two volume-changing means is provided near its end opposite the first-mentioned end thereof with a further engaging means operable to form-lockingly engage with complementary engaging means of a manual volume-changing actuating member adapted to be installed when the driving members have been stopped in said predetermined position.

7. A filling machine according to claim 6, characterized by volume-changing safety switch means to be actuated upon installation of the interconnecting means so as to prevent inadvertent restarting of the driving members before the interconnecting means is removed upon completion of the volume adjustment.

8. A filling machine with a driving motor operatively connected with said driving members according to claim 7, characterized in that the volume-changing stopping means includes a selectively operable switch means operable to effectively interrupt the drive from said driving motor in said predetermined position, and in that said volume-changing safety switch means in series-connected with said first-mentioned switch means.

9. A filling machine according to claim 8, characterized in that the number of filling units actuated in unison by said common driven member is greater than two.

10. A filling machine according to claim 9, characterized in that all of the filling units of the filling machine are actuated in unison by said driven member.

11. A filling machine according to claims 9 or 10, characterized by further volume-adjusting means operatively connecting the cylinder means of a respective one of said filling units with said relatively fixed part to enable individual adjustment of the volume dispensed by a respective filling unit during operation of the filling machine.

12. A filling machine according to claim 11, characterized in that each further volume-adjusting means includes adjustable lost motion means to selectively vary the lost motion between said cylinder means and said relatively fixed part during the suction and discharge strokes of the corresponding pump assembly.

13. A filling machine according to claim 12, characterized in that the adjustable lost motion means includes a swivel member provided with an elongated slot, a bearing member having a bearing portion of a width substantially complementary to the width of the slot to enable free sliding movement of the bearing portion within said slot, and means for selectively limiting the free sliding movement of said bearing portion in said slot.

14. A filling machine according to claim 13, characterized in that said limiting means includes a threaded adjusting member extending longitudinally into the slot and adapted to be selectively screwed-in or out of a threaded bore provided in said swivel member at least approximately coaxially with the longitudinal direction of the slot.

15. A filling machine according to claim 13, characterized in that said bearing member includes a collar portion of a diameter larger than the width of said slot and is operatively connected with said relatively fixed part in such a manner that said swivel member is disposed between said collar portion and said relatively fixed part.

16. A filling machine according to claim 15, characterized in that the volume-changing means includes rotating eccentric members whose eccentricities are adjustable by said lead screw means.

17. A filling machine according to claim 16, characterized in that a respective swivel member is pivotally connected with said cylinder means about a pivot axis extending substantially at right angle to the longitudinal direction of said slot.

18. A filling machine according to claim 1, characterized by volume-changing safety switch means to be actuated upon installation of the interconnecting means so as to prevent inadvertent restarting of the driving members before the interconnecting means is removed upon completion of the volume adjustment.

19. A filling machine with a driving motor operatively connected with said driving members according to claim 18, characterized in that the volume-changing stopping means includes a selectively operable switch means operable to effectively interrupt the drive from said driving motor in said predetermined position, and in that said volume-changing safety switch means in series-connected with said first-mentioned switch means.

20. A filling machine according to claim 1 or 18, characterized in that all of the filling units of the filling machine are actuated in unison by said driven member.

21. A filling machine according to claim 1, characterized by further volume-adjusting means operatively connecting the cylinder means of a respective one of said filling units with said relatively fixed part to enable individual adjustment of the volume dispensed by a respective filling unit during operation of the filling machine.

22. A filling machine according to claim 21, characterized in that each further volume-adjusting means includes adjustable lost motion means to selectively vary the lost motion between said cylinder means and said relatively fixed part during the suction and discharge strokes of the corresponding pump assembly.

23. A filling machine according to claim 22, characterized in that the adjustable lost motion means includes a swivel member provided with an elongated slot, a bearing member having a bearing portion of a width substantially complementary to the width of the slot to enable free sliding movement of the bearing portion within said slot, and means for selectively limiting the free sliding movement of said bearing portion in said slot.

24. A filling machine according to claim 23, characterized in that said limiting means includes a threaded adjusting member extending longitudinally into the slot and adapted to be selectively screwed-in or out of a threaded bore provided in said swivel member at least approximately coaxially with the longitudinal direction of the slot.

25. A filling machine according to claim 23 or 24, characterized in that said bearing member includes a collar position of a diameter larger than the width of said slot and is operatively connected with said relatively fixed part in such a manner that said swivel member is disposed between said collar portion and said relatively fixed part.

26. A filling machine according to claim 24, characterized in that all of the filling units of the filling machine are actuated in unison by said driven member.

27. A filling machine according to claim 2, characterized in that the volume-changing means includes rotating eccentric members whose eccentricities are adjustable by said lead screw means.

* * * * *